US005969369A

United States Patent [19]

Fogarty

[11] Patent Number: 5,969,369

[45] Date of Patent: Oct. 19, 1999

[54] INFRARED EMISSIVE MODULE

[76] Inventor: Charles M. Fogarty, 3644 Burnette Rd., Suwanee, Ga. 30174

[21] Appl. No.: 08/920,593

[22] Filed: Aug. 29, 1997

[51] Int. Cl.[6] ..... H05B 3/26

[52] U.S. Cl. ..... 250/495.1; 250/504 R

[58] Field of Search ..... 750/493.1, 494.1, 750/495.1, 504 R; 273/348.1

[56] References Cited

U.S. PATENT DOCUMENTS

| | | | |
|---|---|---|---|
| 4,240,212 | 12/1980 | Marshall et al. . | |
| 4,250,398 | 2/1981 | Ellis et al. . | |
| 4,253,670 | 3/1981 | Moulton et al. . | |
| 4,260,160 | 4/1981 | Ejnell et al. . | |
| 4,279,599 | 7/1981 | Marshall et al. . | |
| 4,319,135 | 3/1982 | Steinhage . | |
| 4,346,901 | 8/1982 | Booth . | |
| 4,405,132 | 9/1983 | Thalmann . | |
| 4,422,646 | 12/1983 | Rosa . | |
| 4,505,481 | 3/1985 | Knight . | |
| 4,546,983 | 10/1985 | Rosa . | |
| 4,605,232 | 8/1986 | Hundstad . | |
| 4,659,089 | 4/1987 | Rosa . | |
| 4,706,963 | 11/1987 | Geuss . | |
| 4,792,142 | 12/1988 | Davies . | |
| 4,799,688 | 1/1989 | Kellman et al. . | |
| 4,883,971 | 11/1989 | Jensen | 250/495.1 |
| 4,922,116 | 5/1990 | Grinberg et al. | 250/495.1 |
| 4,946,171 | 8/1990 | Merle et al. | 250/495.1 |
| 5,065,032 | 11/1991 | Prosser . | |
| 5,066,019 | 11/1991 | Dean et al. . | |
| 5,238,406 | 8/1993 | Littell, III . | |
| 5,296,270 | 3/1994 | Prosser . | |
| 5,444,262 | 8/1995 | Campagnuolo et al. . | |

FOREIGN PATENT DOCUMENTS

| | | |
|---|---|---|
| 0581737 | 2/1994 | European Pat. Off. . |
| 3133846 | 3/1983 | Germany . |
| 3439689 | 5/1986 | Germany . |
| 3514973 | 10/1986 | Germany . |
| 3827413 | 2/1990 | Germany . |
| 2257499 | 1/1993 | United Kingdom . |
| 2264358 | 8/1993 | United Kingdom . |

OTHER PUBLICATIONS

United States Statutory Invention Registration No. H694, Published: Oct. 3, 1989/Inventor: Czajkowski, Jr.

United States Statutory Invention Registration No. H679, Published: Sep. 5, 1989/Inventor: Czajkowski, Jr.

Abstract, EP 638780–A1; Applicant: Wegmann & Co GMBH; WEGM Aug. 9, 1993.

International Application No. WO 83/01105; International Filing Date: Sep. 17, 1982; Applicant: TVI Energy Corporation.

*Primary Examiner*—Kiet T. Nguyen

*Attorney, Agent, or Firm*—Nixon, Peabody LLP

[57] ABSTRACT

A flexible infrared emissive module comprises an electrically insulating carrier layer (12), an electrically conductive layer (14) mounted to the carrier layer, an electrically insulating top layer (18) mounted to the carrier and electrically conductive layers on one side of the carrier layer and an electrically insulating bottom layer (16) mounted to the other side of the carrier layer. The carrier layer comprises a vinyl film, and the top and bottom layers comprise a polyester film, which are mounted to the carrier layer by a heat and pressure sensitive adhesive. The electrically conductive layer comprises a fibrous composite of a fluoroelastomer and carbon, wherein the electrically conductive layer is comprised mainly of the fluoroelastonier. Electrical current is supplied to the electrically conductive layer from an electrical power source (3) by a networked series-parallel power and ground plane circuit (20) that provides even distribution of the electrical current and circuit redundancy enabling the module to continue to function with little or no change in infrared emission after being perforated by projectiles.

16 Claims, 9 Drawing Sheets

INFRARED EMISSIVE MODULE

BACKGROUND OF THE INVENTION

I. Field of the Invention

The present invention relates generally to the field of heat emitting devices. More particularly, the present invention relates to a unitary, composite, flexible, laminated infrared emissive module having redundant circuitry that is well suited for use as an infrared target.

II. Description of the Related Art

It is well known that objects having a surface temperature greater than absolute zero are capable of dissipating energy into the environment in the form of infrared radiation. Under certain circumstances, devices which emit infrared radiation can be utilized to heat objects or structures and can be utilized as a target for weaponry having infrared detection devices that "see" infrared emitting device's thermal signature.

In U.S. Pat. No. 4,250,398, Ellis et al. describe a solid state electrically conductive laminate. The laminate has a substantially continuous, electrically conductive layer of substantially uniform thickness comprised mainly of carbon that emits infrared radiation when an electric current is passed through it. This layer is specifically described as a homogeneous blend of about 60% to about 98% by weight of graphite, about 1.5% to about 20% by weight of manganese dioxide, and about 0.5% to about 20% by weight of zinc oxide. The electrically conductive layer is described as being applied to a flexible binder by silkscreen application. A pair of busbars having opposite electrical polarity arc placed in contact with the electrically conductive layer in varying arrangements. However, the busbars are not in a networked series-parallel power and ground plane circuit arrangement and if one of the busbars is dissected, major portions, if not all, of the electrically conductive layer cease to emit infrared radiation. The electrically conductive layer is disposed between a pair of barrier layers, which are additionally disposed between a pair of insulating layers.

Rosa, a co-inventor of U.S. Pat. No. 4,250,398 described above, in U.S. Pat. Nos. 4,422,646, 4,546,983 and 4,659,089 describes infrared targets likewise having a substantially continuous, electrically conductive layer of substantially uniform thickness comprised mainly of carbon that emits infrared radiation when an electric current is passed through it. The electrically conductive layer is not well described except that it is comprised mainly of carbon. This device also has a pair of busbars of opposite electrical polarity, except that each busbar is respectively connected at each end thereof to its mating electrical pole of an electrical source. This device likewise does not have a networked series-parallel power and ground plane circuit arrangement, and if one of the busbars is dissected, major portions, if not all, of the electrically conductive layer cease to emit infrared radiation. As a target, this device's usefulness is limited, because once the busbars have received a relatively few number of "hits" by a projectile fired by a weapon, it ceases to produce an even thermal signature. It appears that this device is improved over the device described by Ellis et al. only in that both ends of each busbar is connected to a respective pole of an electrical power source and does not have barrier layers.

SUMMARY OF THE INVENTION

In accordance with the present invention and the contemplated problems which have and continue to exist in this field, one of the objectives of this invention is to provide an infrared emissive module that is new, unique and improved over the prior art.

It is another objective of the present invention to provide a networked series-parallel power and ground plane circuit to provide even distribution of an electrical current across an electrically conductive layer of the infrared emissive module.

Yet, it is another objective of the present invention to provide a flexible electrically conductive layer that is a composite of a fluoroelastomer and carbon, and the composite is mainly the fluoroelastomer.

Still, it is another objective of the present invention to provide an infrared emissive module that can be utilized as a target for live fire exercises that utilize equipment which can view an infrared emission.

This invention accomplishes the above and other objectives and overcomes the disadvantages of the prior art by providing an infrared emissive module that is simple in design and construction, inexpensive to fabricate, and easy to use. The module comprises an electrically insulating carrier layer, an electrically conductive layer mounted to the carrier layer, an electrically insulating top layer mounted to the carrier and electrically conductive layers on one side of the carrier layer and an electrically insulating bottom layer mounted to the other side of the carrier layer to form a unitary, composite, laminated infrared emissive module. The carrier layer comprises a vinyl film, and the top and bottom layers comprise a polyester film, which are mounted to the carrier layer by a heat and pressure sensitive adhesive. The electrically conductive layer is a flexible composite of a fluoroelastomer and carbon, wherein the electrically conductive layer is comprised mainly of the fluoroelastomer and is applied to the carrier layer by spraying to form fibers and atomized particles. Electrical current is supplied to the electrically conductive layer from an electrical power source by a networked series-parallel power and ground plane circuit that provides even distribution of the electrical current and circuit redundancy enabling the module to continue to function with little or no change in infrared emission after being perforated by projectiles.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 1:
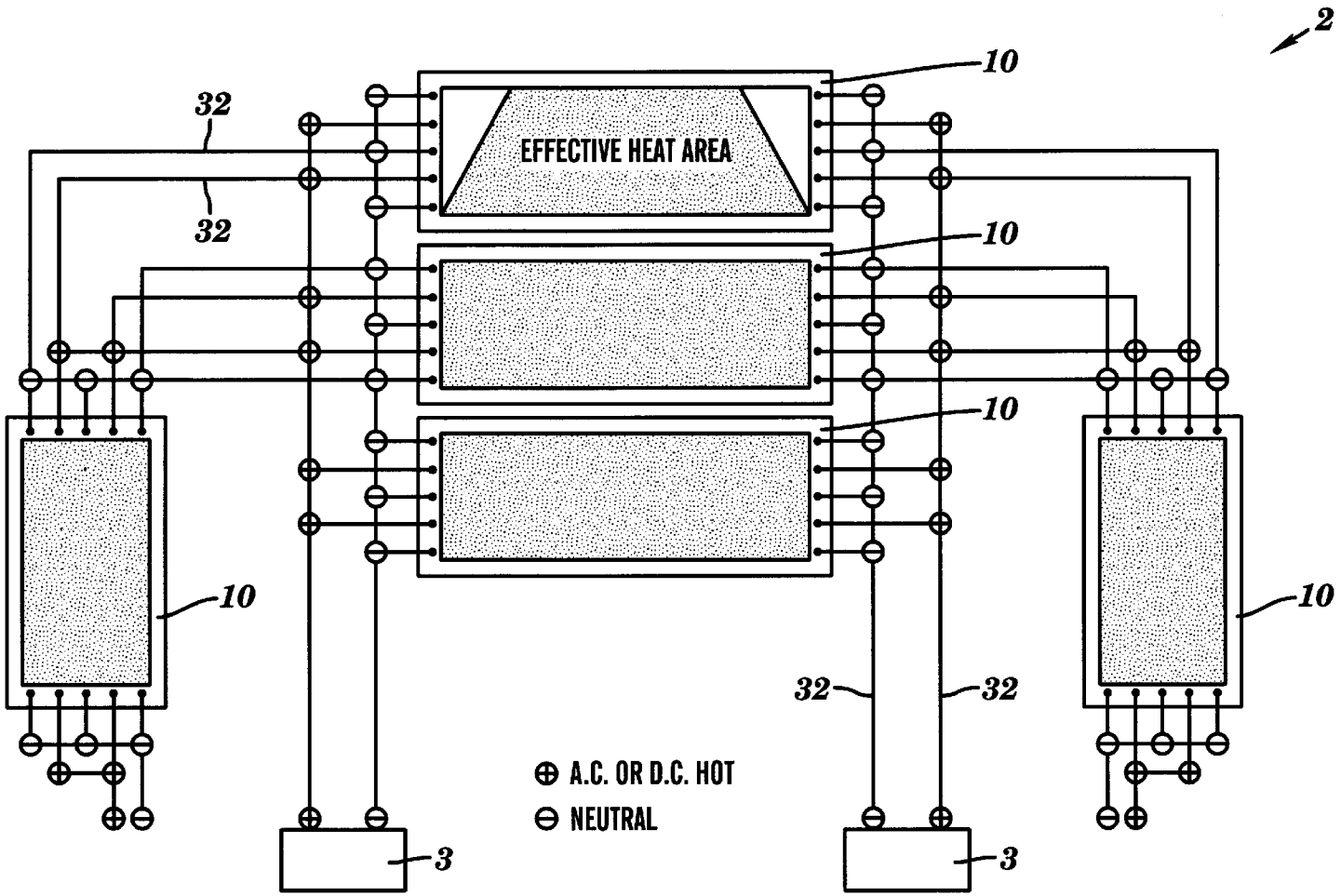
FIG. 1 is a front elevation view, partially in schematic form, of a plurality of infrared emissive modules constructed in accordance with the present invention and arranged to form a typical thermal target silhouette, particularly that of a tank, including a diagrammatic illustration of an electrical power supply and connections thereto.

The reference numbers in the drawings relate to the following:

2=thermal target

3=electrical power source

10=infrared emissive module

12=carrier layer

14=electrically conductive layer

16=bottom layer

18=top layer

20=networked series-parallel power and ground plane circuit

22=busbar

24=connector bar

26=cross-over

28=insulation layer

30=connection pad

32=wire

34=fiber of electrically conductive layer

36=interstitial area of electrically conductive layer

38=grommet

40=perforated hole

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a thermal target 2 comprised of a plurality of infrared emissive modules 10 constructed in accordance with the present invention. Although the arrangement of infrared emissive modules 10 of FIG. 1 provides the thermal target 2 with a thermal silhouette of a tank, it should be readily apparent that the infrared emissive modules 10 can be arranged in various configurations to produce thermal silhouettes of other objects, including people. Additionally, is should as well be readily apparent that the infrared emissive module 10 can be utilized as a heat source to provide heat or warmth for most any occasion or circumstance where such heating needs apply.

The infrared emissive module 10 comprises a unitary, composite, flexible laminate. Referring additionally to FIGS. 2 through 6, the infrared emissive module 10 has an electrically insulating carrier layer 12, an electrically conductive layer 14, an electrically insulating bottom layer 16 and an electrically insulating top layer 18. To conduct electricity from an electrical power source 3 to the electrically conductive layer 12, the module 10 has a networked series-parallel power and ground plane circuit 20 operatively connected to the electrical power source 3.

The carrier layer 12 can be made of any electrically insulating material. For example, certain metallic alloys are electrically non-conductive and can be readily utilized in the present invention. Preferably, the carrier layer 12 is made of a flexible, flame retardant, electrically insulating material, such as a vinyl film. Vinyl, or polyvinyl chloride, film is most preferred because it provides the module 10 with improved material strength, tear resistance and flame retardance, which produces a self-extinguishing characteristic.

Figure 2:
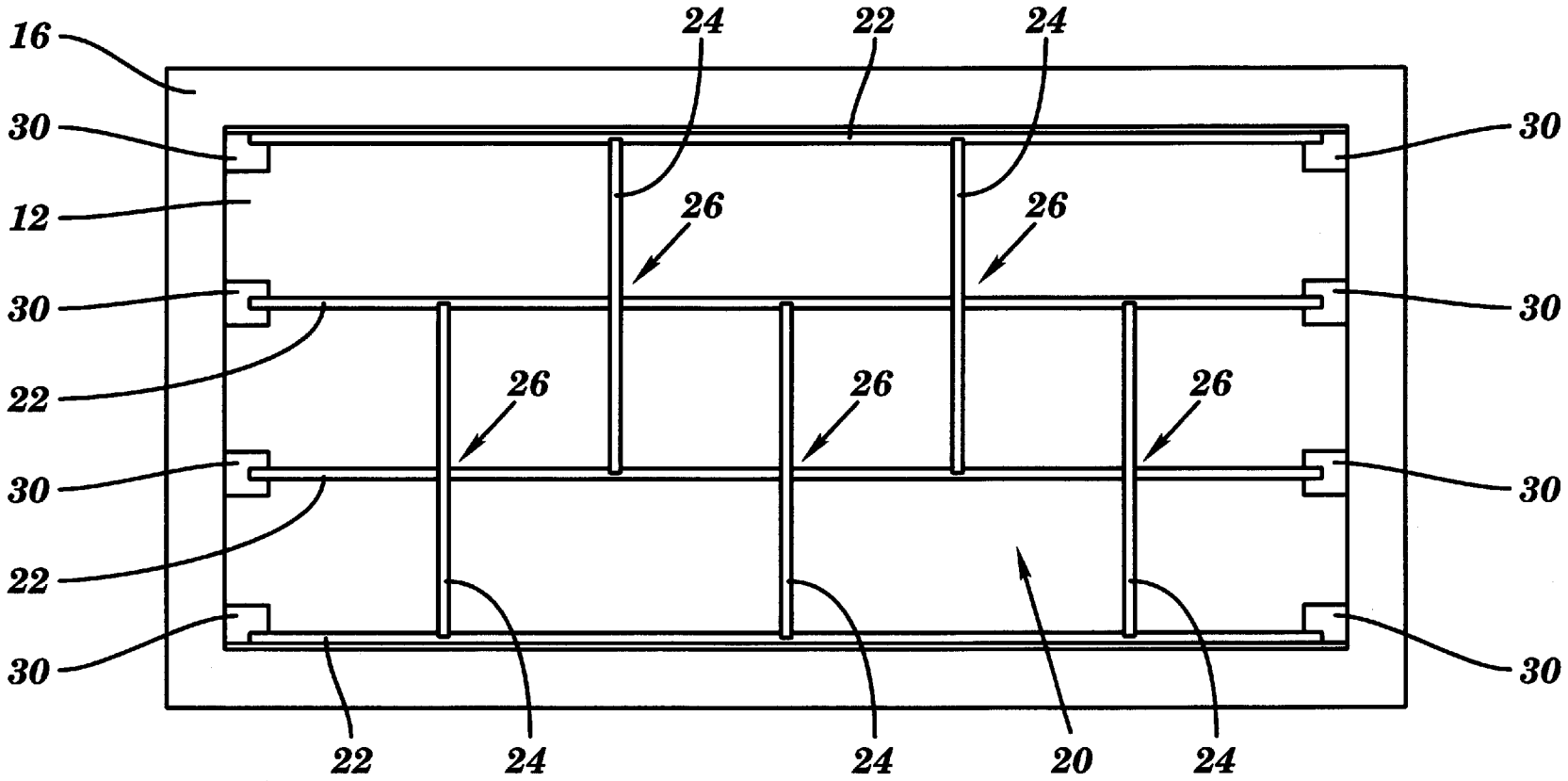
FIG. 2 is a plan view of an embodiment of the present invention with a networked series-parallel power and ground plane circuit mounted to a carrier layer.

In the embodiment shown in FIG. 2, the networked series-parallel power and ground plane circuit 20 is mounted directly to the carrier layer 12. The circuit 20 has a plurality of busbars 22 and at least one connector bar 24. The busbars 22 and the connector bars 24 are made of an electrically conductive material, preferably a flexible electrically conductive material. Suitable materials for bars 22 and 24 are electrically low-resistive composites of carbon dispersed in a suitable cured binder system, silver wire, strip or tape, copper wire, strip or tape, aluminum wire, strip or tape, and electrically conductive pastes. Again, referring to FIGS. 1 and 2, the busbars 22 are mounted to the carrier layer 12 substantially equal-distantly from and substantially parallel to one another to prevent "hot spots" from being developed by the electrically conductive layer 14. This aides in the prevention of uneven electrical resistance between a busbar 22 of one electrical pole to a busbar 22 having the opposite electrical pole. The busbars 22 are arranged so that the electrical polarity is alternated, as shown in FIG. 1. The connector bars 24 are provided to operatively, electrically connect busbars having the same electrical polarity. In the event the operative electrical connection to the power source 3 of a particular busbar 22 is severed, the connector bar 24 continues to provide operative electrical connection to the respective pole of the electrical power source 3 to the isolated portion of the busbar 22. An intersection of a busbar 22 of one electrical polarity and a connector bar 24 having the opposite electrical polarity is defined as a cross-over 26. An exemplary cross-over 26 is detailed in FIG. 4. Each cross-over 26 has an electrically-insulating insulation layer 28 disposed between the busbar 22 and the connector bar 24 to prevent current flow. At intersections of busbars 22 and connector bars 24 having the same electrical polarity, the bars 22 and 24 are electrically interconnected or bonded to one another by means of welding, stapling, conductive ink-flexible, conductive paste, crimping and conductive adhesive, preferably by a conductive epoxy adhesive, to provide current flow having minimal resistance. The power and ground connections, described immediately above, can be arranged in precise redundant geometrical patterns that can be repeated such that any number of opposite polarity paths call be developed to enable the module 10 to withstand numerous live fire hits or perforations when used as a target or provide numerous circuit redundancies when required in applications where thermal heat supplies arc critical. At either end of the busbars 22 are optional connection pads 30 made of an electrically conductive material to assist in connecting the busbars 22 to the appropriate pole of the electrical power source 3.

Because of the redundant circuitry of networked series-parallel power and ground plane circuit 20, several hits to a single busbar 22 will not necessarily disable that portion of the module 10, let alone the entire module 10. Additionally, each module 10 can be quickly repaired on site using simple tools and inexpensive materials.

Referring again to FIG. 1, in order to connect the busbars 22 to the electrical power source 3, they are provided with external electrical wires 32, usually having clip connectors (not shown) to grip the module 10 at both ends of the respective busbar 22. To provide additional redundancy and additional life to the module 10 when being utilized as a target, wires 32 having the same electrically polarity are also connected in series. Additionally, these connections can be made by crimping, soldering, brazing or otherwise securing electrical connections. Particularly shown in FIG. 4, another insulation layer 28 is mounted to the connector bar 24 prior to the addition of the electrically conductive layer 14 to prevent electrical contact between the connector bar 24 and the electrically conductive layer 14. The insulation layer 28 preferably comprises polyester tape.

Figure 3:
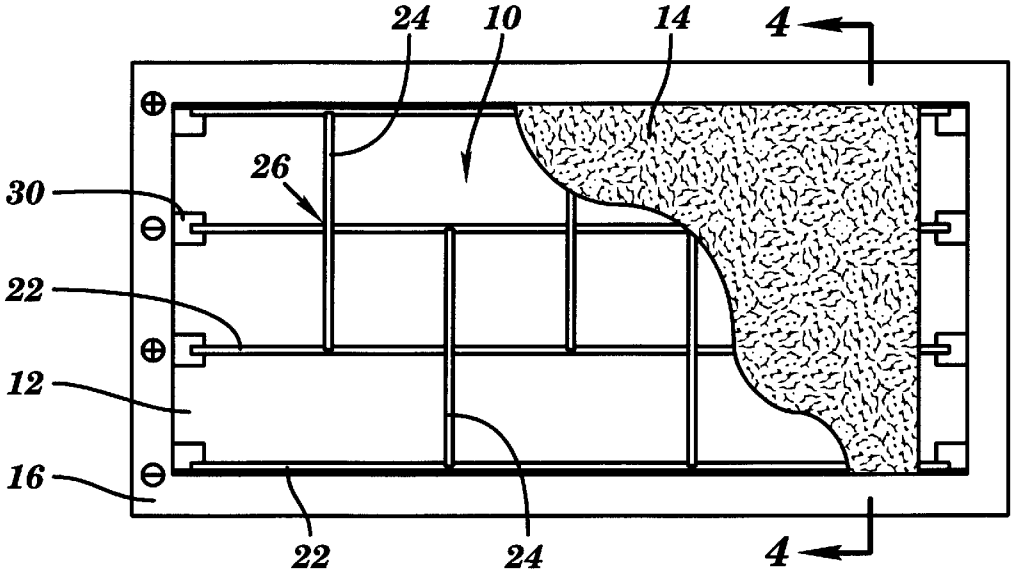
FIG. 3 is a partial view of an electrically conductive layer mounted to the embodiment of FIG. 2.
Figure 4:
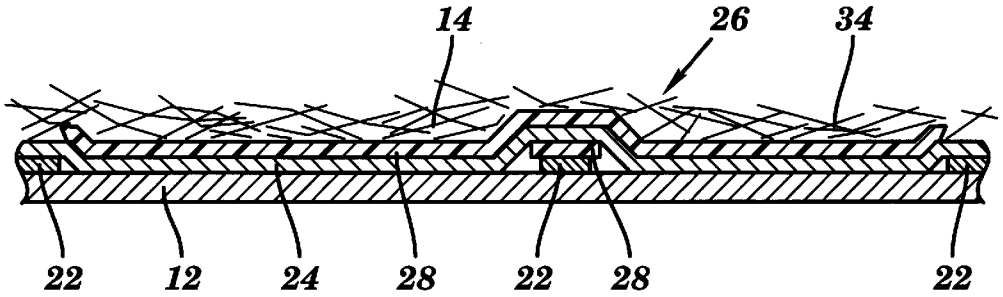
FIG. 4 is a partial sectional view of the embodiment depicted in FIG. 3 taken along line 4—4 and looking in the direction of the arrows illustrating a cross-over.
Figure 5:
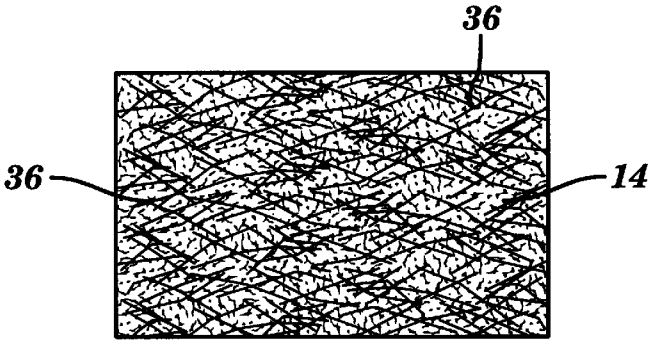
FIG. 5 is an enlarged view of a portion of the electrically conductive layer.

Now, referring additionally to FIGS. 3 through 5, the electrically conductive layer 14 is mounted to the carrier layer 12 and the busbars 22. The electrically conductive layer 14 is a composite comprising carbon, or graphite, and a fluoroelastomer, preferably a tetrafluoroethylene/vinylidene fluoride copolymer. It is neither necessary nor desired for the electrically conductive layer 14 to be mainly comprised of carbon when utilizing the fluoroelastomer. It has been found that the electrically conductive layer 14 enables the module 10 to operate and remain flexible in temperature ranges between minus forty degrees F. (−40 deg. F.) to five hundred degrees F. (500 deg. F.), resist oxidation and cure at room temperature. Propel application of the electrically conductive layer 14 is critic al. Prefer ably, the electrically conductive layer 14 is applied by spraying. In order to retain flexibility, the spray nozzle (not shown) must be adjusted so that the composite exits the nozzle in a combination of atomized particles and fine fiber, or filament, having the consistency similar to that of spider web. Referring now to FIGS. 4 and 5, the electrically conductive layer 14, after application thereof, has a general thickness of 0.001 inch, but the thickness of the electrically conductive layer 14 is non-uniform. Additionally, the electrically conductive layer 14 has fibers 34, particles interposed between the fibers, and interstitial areas 36 disposed within the fibers 34 and particles. Even though the electrically conductive layer 14 has a non-uniform thickness, there is an even emission of infrared radiation. There is an inverse linear relationship between the weight of the electrically conductive layer and the resulting resistivity, and also between the laminating pressure and temperature to which the electrically conductive layer 14 is subjected. TO achieve a lower wattage output, a smaller amount of the electrically conductive layer 14 is needed. By increasing, the thickness of the electrically conductive layer 14, a greater wattage output occurs. However, the electrically conductive layer 14 must be applied so that the fibers 34 and the interstitial areas 36 are produced as described above to maintain flexibility. The fibers 34 are substantially electrically interconnected throughout the electrically conductive layer 14. Although the electrically conductive layer 14 will generate an infrared emission when it is substantially continuous arid has a substantially uniform thickness, the electrically conductive layer 14 is brittle, even at atmospheric conditions. Additionally, bonding between the busbars 22 and the electrically conductive layer 14 is reduced, causing an increase in electrical resistance and reduced thermal generation. A suitable composite composition for spraying has about 84% to 85% methyl ethyl ketone by volume as a solvent, about 11% to 12% fluoroelastomer by volume and about 1 to 4.3% carbon by volume. Carbon black may also be dispersed within the composite. Because the fluoroelastomer has good moisture resistance, the module 10 continues to function acceptably even after an object has been fired through it.

Figure 6:
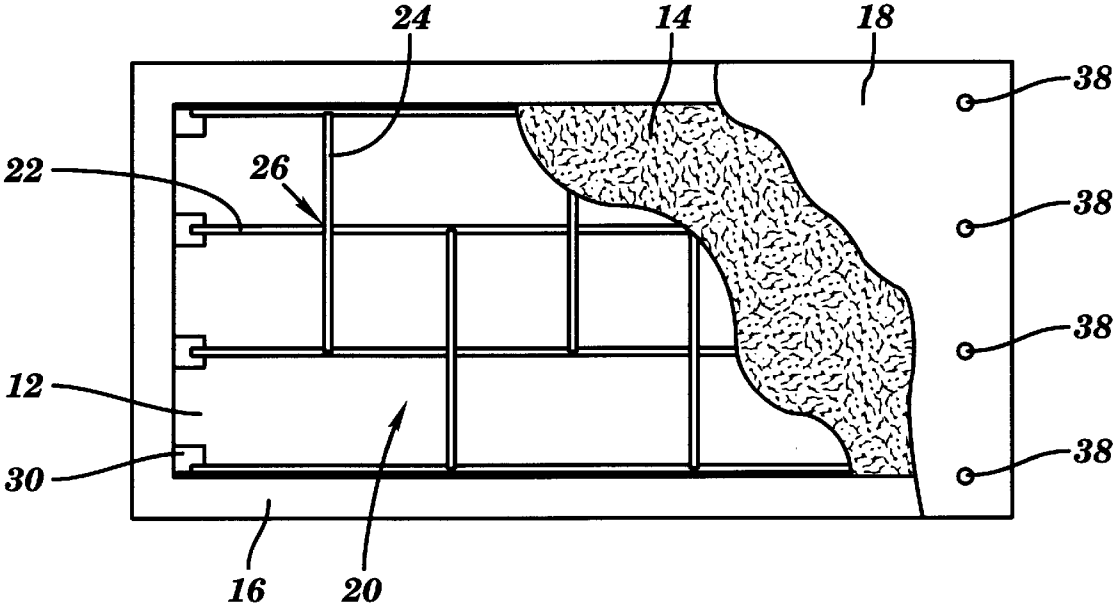
FIG. 6 is a partial view of the embodiment of FIG. 2

With continued reference to FIGS. 2 through 5 and especially FIG. 6, the module 10 is protected by the electrically insulating bottom layer 16 and top layer 18. Preferably, the bottom and top layers 16 and 18 are made of a polyester film. The bottom and top layers 16 and 18 can be of the same composition as the carrier layer 12. Although any conventional method may be utilized to affix the bottom and top layers to the carrier and electrically conductive layers 12 and 14, it is preferred to bond the bottom and top layers 16 and 18 to the carrier and electrically conductive layers 12 and 14 with a heat and pressure sensitive adhesive. By pressing and heating the module 10 as the bottom and top layers 16 and 18 are applied, the electrically conductive layer 14 has improved electrical contact with the busbars 22 and the top layer 18 bonds directly to the carrier layer 12 through the electrically conductive layer 14 via the interstitial areas 36, improving the strength, and the tear and weather resistance of the module 10 as compared to the prior art.

To connect the wires 32 to the busbars 22, any standard electrical connection device may be utilized. In one embodiment, brass spur grommets 38 are anchored into the module 10 thereby making intimate electrical contact with the busbars 22.

Figure 7:
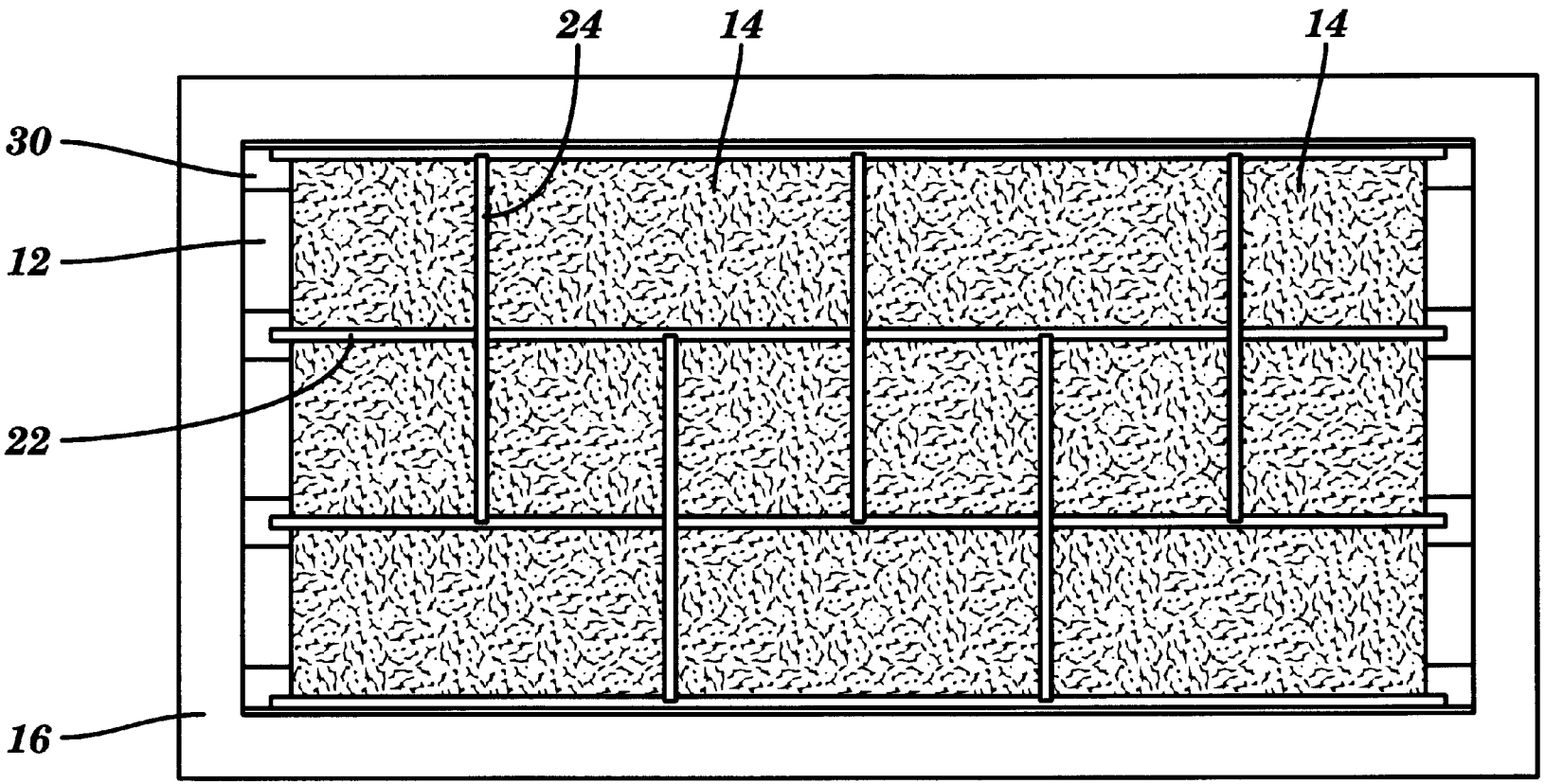
FIG. 7 is a plan view of another embodiment of the present invention with the electrically conductive layer mounted to the carrier layer and the networked series-parallel power and ground plane circuit mounted to the electrically conductive layer.
Figure 8:
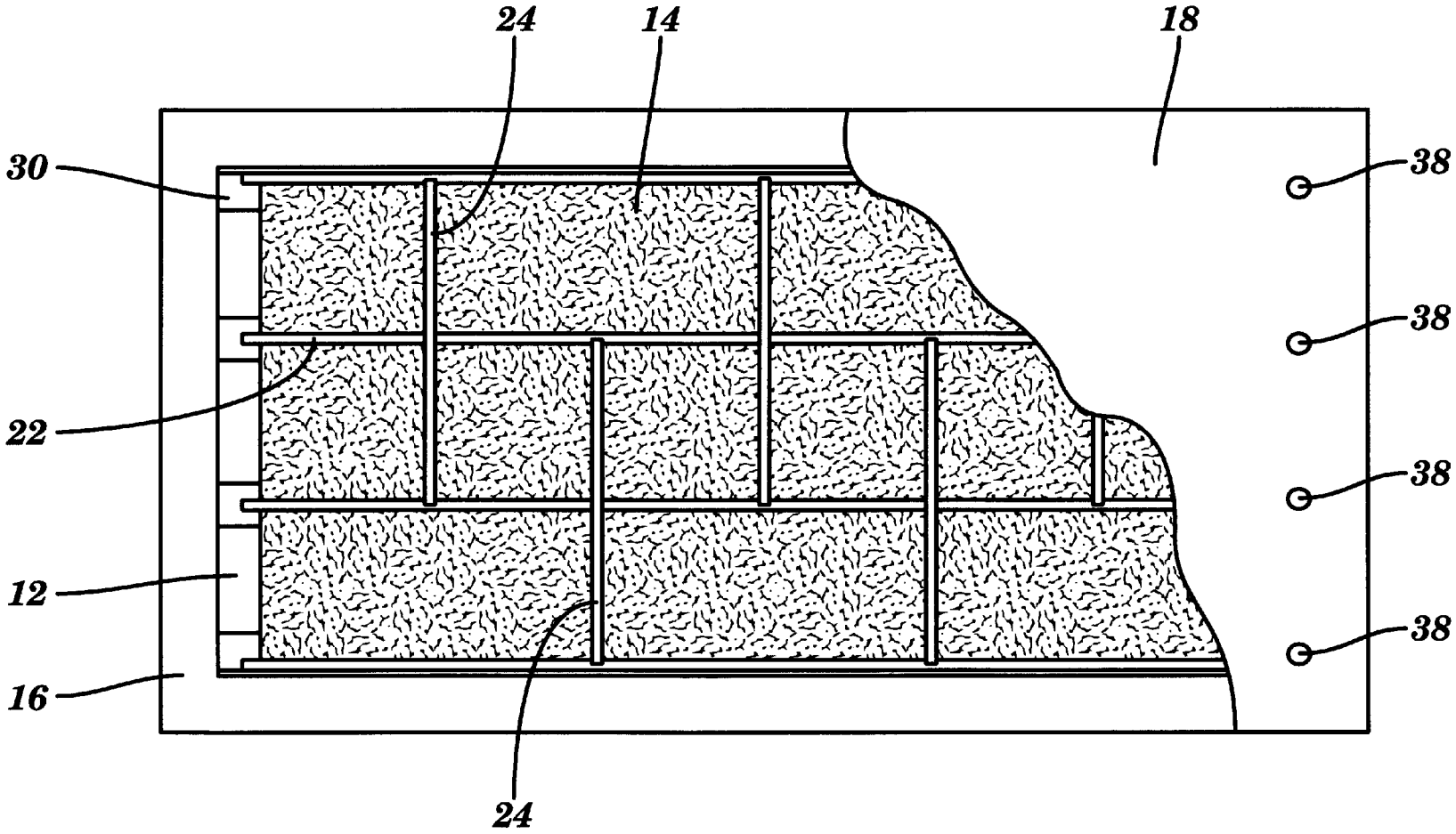
FIG. 8 is a partial view of the embodiment of FIG. 7.

Referring now to FIGS. 7 and 8, another embodiment of the present invention is shown. In this embodiment, the electrical conductive layer 14 is mounted to the carrier layer 12 before the networked series-parallel power and ground plane circuit 20 is applied to the module 10. The insulation layer 28 is likewise disposed between the connector bars 24 and the electrically conductive layer 14. The remaining features of this embodiment remain the same as previously described.

Figure 9:
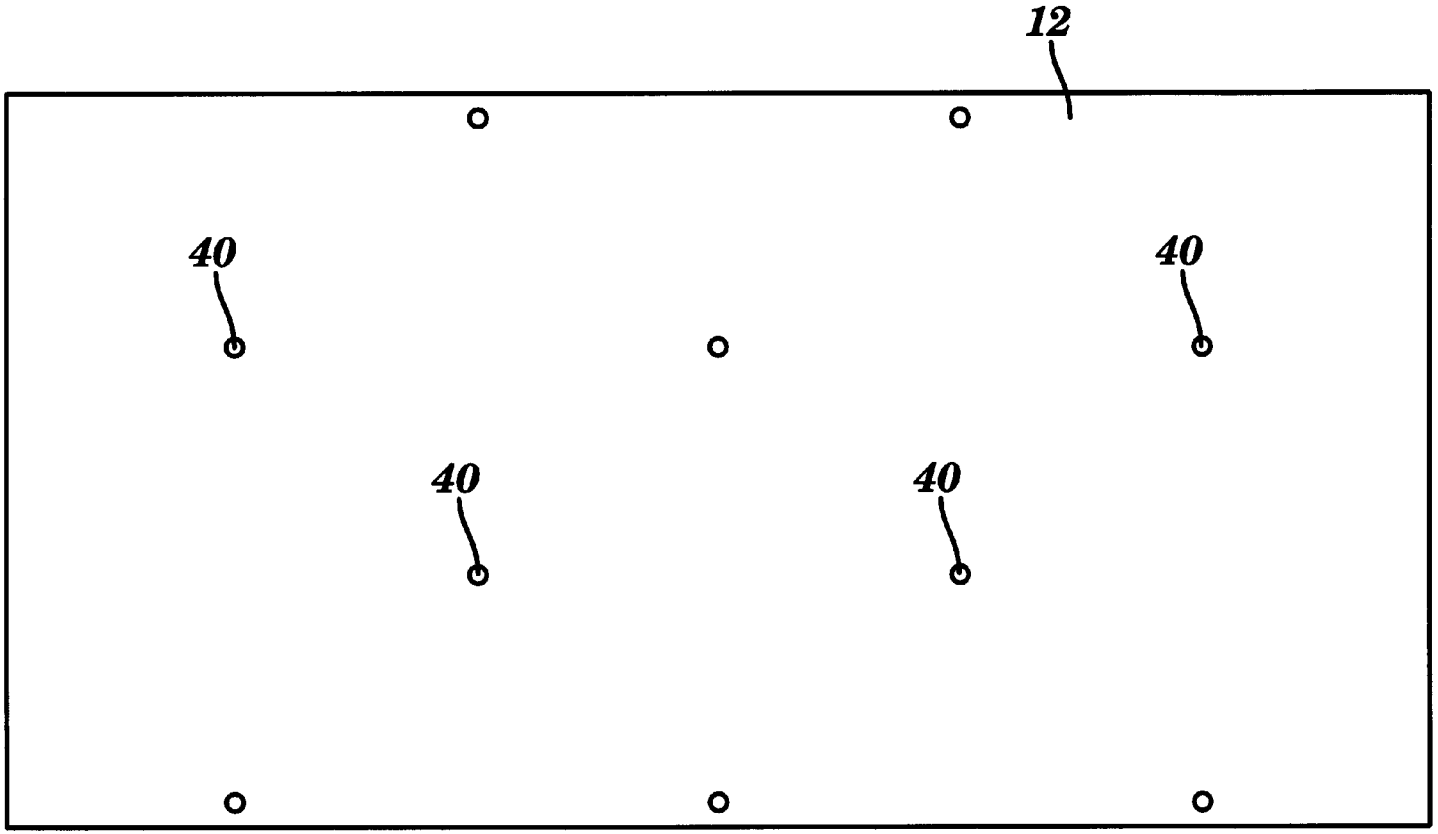
FIG. 9 is a plan view of the carrier layer having perforations.
Figure 10:
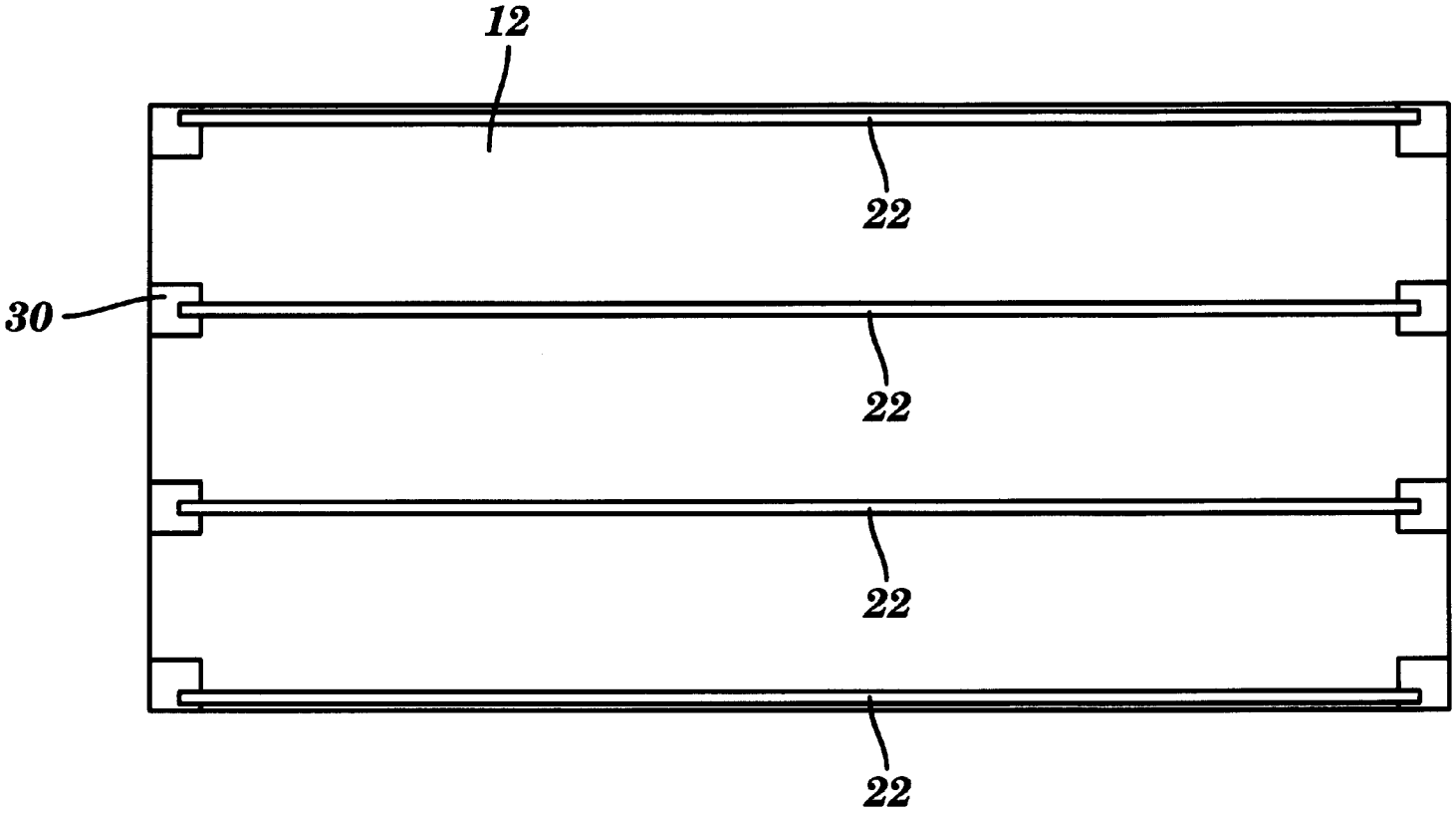
FIG. 10 is a front view of the carrier layer of FIG. 9 having busbars mounted thereto.
Figure 11:
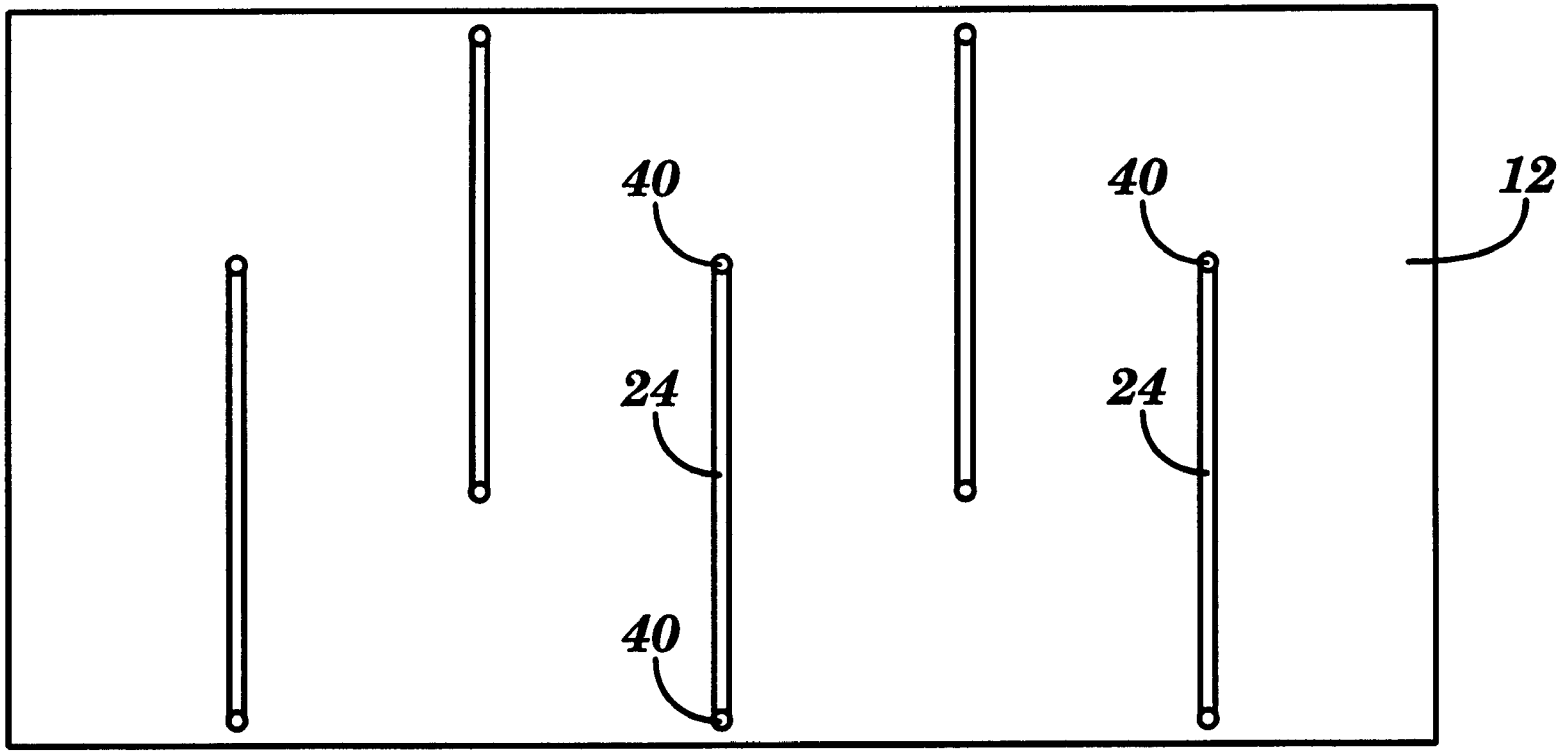
FIG. 11 is a back view of the carrier layer of FIG. 9 having connector bars of the series parallel power and ground plane circuit mounted thereto.

Yet, another embodiment is shown in FIG. 9 through 11. In this embodiment, as shown in FIG. 9, the carrier layer 12 has perforations 40 at the locations of the intersections of like polarized busbars 22 and connector bars 24. FIG. 10 shows the busbars 22 disposed on one side of the carrier layer 12 extending over the respective perforations 40, and FIG. 10 shows the connector bars 24 disposed on the opposite side of the carrier layer 12 extending from the respective perforations. In this configuration, the insulation layer 28 between the connector bars 24 and the electrically conductive layer 14 is not needed, because the carrier layer 14 provides the needed electrical insulation. The remaining features of this embodiment are the same as described above. In this configuration, the electrically conductive layer 14 may be applied to the side of the carrier layer 12 having the busbars 22 prior to the mounting of the busbars 22. The busbars 22 and the connector bars 24 are placed in electrical contact with each other through the perforations 40. If there are no perforations, then the busbars 22 and the connector bars 24 are placed in electrical contact with each other by means of conductive inks, pastes, epoxies, adhesives, staples and by sewn metallic threads.

Because of the uniformity provided in the module 10, thermal and visual signals are identical from module to module. Furthermore, firing conditions can be duplicated from day to day with the only variable being environmental conditions. Additionally, because of the modular design, modules 10 are separate and independent of one another so that damaged to one module, has no effect on the signal emitted by the remaining interlinked modules 10.

It should be readily apparent that a minimum of two busbars 22 having opposite polarity are needed to provide an electric current from an electrical power source 3 to the electrically conductive layer 14.

Modules 10 having 8 square feet emissive area made in accordance with the present invention have been subjected to a current passed across the electrically conductive layer 14 to yield the following approximate module surface temperature increases above atmospheric temperature:

| VOLTS | AMPS/ SQ. FT. | WATT/ SQ. FT. | TEMP. DEG. F./SQ. FT. |
|---|---|---|---|
| 120 A.C. | 0.08 | 9 | 4 |
| l20 A.C. | 0.10 | 12 | 7 |
| l20 A.C. | 0.13 | 15 | 10 |
| 120 A.C. | 0.15 | 18 | 13 |
| 12 D.C. | 0.75 | 9 | 4 |
| 12 D.C. | 1.00 | 12 | 7 |
| l2 D.C. | 1.25 | 15 | 10 |
| l2 D.C. | 1.5 | 18 | 13 |

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which arc set forth in the appended claims.

What is claimed is:

1. A unitary, composite, laminated infrared emissive module connectable to an electrical power source having two, oppositely-charged electrical poles, comprising:

an electrically insulating carrier layer;

an electrically conductive layer disposed on the carrier layer, the electrically conductive layer generating an infrared emission when an electric current is passed therethrough; and a power and ground plane circuit operatively connecting the electrically conductive layer to the electrical current, wherein the power and around plane circuit comprises a plurality of substantially parallel electrically conductive busbars operatively connected to the power source with adjacent busbars being operatively connected to opposite poles of the power source; and at least one connector bar electrically connecting at least two busbars of like electrical charge, whereby each busbar has at least two operative connections to the electrical power source.

2. An infrared emissive module as claimed in claim 1, wherein the carrier layer, the electrically conductive layer and power and ground plane circuit are substantially flexible.

3. An infrared emissive module as claimed in claim 1, wherein the infrared emissive module is a target.

4. An infrared emissive module as claimed in claim 3, wherein the target comprises more than one infrared emissive module.

5. An infrared emissive module as claimed in claim 1, further comprising an electrically-insulating insulation layer disposed between the intersection of a busbar operatively connected to one pole of the electrical power source and a connector bar having the opposite polarity.

6. A unitary, composite, laminated infrared emissive module, comprising:

an electrically insulating carrier layer;

an electrically conductive layer comprising carbon and a fluoroelastomer disposed on the carrier layer and generating an infrared emission when an electric current is passed therethrough; and an electrical circuit operatively connecting the electrically conductive layer to the electrical current.

7. An infrared emissive module as claimed in claim 6, wherein the carrier layer, the electrically conductive layer and the electrical circuit are substantially flexible.

8. An infrared emissive module as claimed in claim 6, wherein the infrared emissive module is a target.

9. An infrared emissive module as claimed in claim 8, wherein the target comprises more than one infrared emissive module.

10. A unitary, composite laminated infrared emissive module, comprising:

an electrically insulating carrier layer;

an electrically conductive layer comprising carbon and a fluoroelastomer disposed on the carrier layer and generating an infrared emission when an electric current is passed therethrough; and a power and ground plane circuit operatively connecting the electrically conductive layer to the electrical current.

11. An infrared emissive module as claimed in claim 10, wherein the carrier layer, the electrically conductive layer and power and ground plane circuit are flexible.

12. An infrared emissive module as claimed in claim 10, further comprising an electrically insulating top layer disposed on the electrically conductive layer.

13. An infrared emissive module as claimed in claim 12, wherein the top and conductive layers are disposed on one side of the carrier layer, and further comprising an electrically insulating bottom layer disposed on another side of the carrier layer.

14. An infrared emissive module as claimed in claim 10, wherein the infrared emissive module is a target.

15. An infrared emissive module as claimed in claim 14, wherein the target comprises more than one infrared emissive module.

16. An infrared emissive module as claimed in claim 10, wherein the electrical current is supplied by an electrical power source having two, oppositely-charged electrical poles, and the power and ground plane circuit comprises:

a plurality of electrically conductive busbars operatively connected to the power source with adjacent busbars being operatively connected to opposite poles of the power source; and at least one connector bar electrically connecting at least two busbars of like electrical charge.

* * * * *